United States Patent [19]

Palmer et al.

[11] 4,134,108

[45] Jan. 9, 1979

[54] EMERGENCY ALARM DEVICE

[75] Inventors: Ray W. Palmer, Waukesha; Fay H. Miller, Milwaukee, both of Wis.

[73] Assignee: Res'Q, Inc., Milwaukee, Wis.

[21] Appl. No.: 761,068

[22] Filed: Jan. 21, 1977

[51] Int. Cl.[2] ..... G08B 3/10

[52] U.S. Cl. ..... 340/539; 340/167 A; 340/348; 325/39; 325/142; 325/364

[58] Field of Search ..... 340/213.1, 224, 348, 340/349, 412, 416, 167 A, 409; 325/38 R, 39, 16, 142, 143, 364, 55, 37

[56] References Cited

U.S. PATENT DOCUMENTS

| | | | |
|---|---|---|---|
| 3,629,837 | 12/1971 | Fraunfelder | 340/224 X |
| 3,868,573 | 2/1975 | Holcomb et al. | 325/16 |
| 3,906,348 | 9/1975 | Willmott | 325/37 |
| 3,909,826 | 9/1975 | Schildmeirer et al. | 340/412 |

*Primary Examiner*—Alvin H. Waring
*Attorney, Agent, or Firm*—Richard P. Ulrich

[57] ABSTRACT

A portable and addressable emergency alarm device which transmits a selected radio frequency alarm signal from a portable transmitter to a stationary receiver and sounds an alarm.

1 Claim, 4 Drawing Figures

Fig. 1.
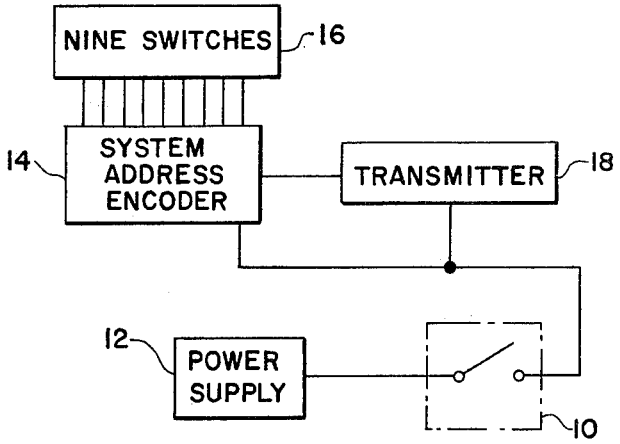
Fig. 2.
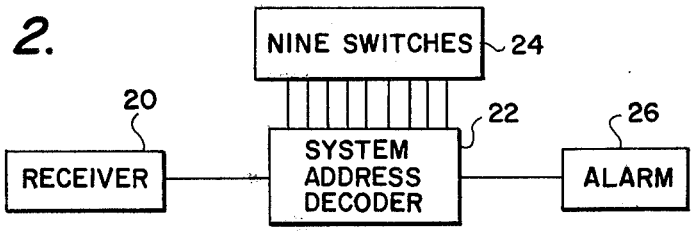
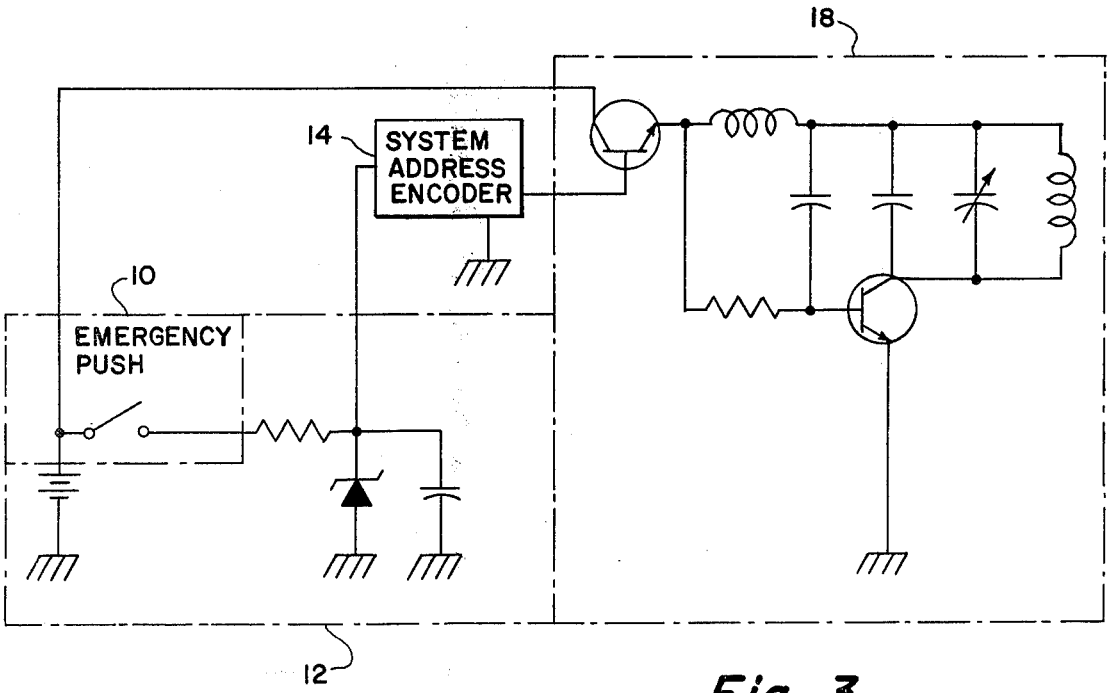
Fig. 3.

EMERGENCY ALARM DEVICE

BACKGROUND AND SUMMARY OF INVENTION

There are several systems in use for providing an alarm in response to the existance of an emergency condition. In some cases they are fixed in position. In still others they are fire or burglar alarms. However, no system of which I am aware provides the flexibility, portability and reliability of the system which is disclosed herein. Therefore, it is an object of this invention to provide a personal emergency alarm system which is both flexible and portable.

It is a further object of this invention to provide the means for operating a plurality of systems in close proximity without interference one with another.

It is another object of this invention to provide an emergency alarm system which can be set off by means which can conveniently be carried on the person.

It is an additional object of this invention to provide a system in which a plurality of emergency signals can be received and recognized by an emergency transmitter.

It is a further object of the invention to provide flexible system address means for identifying the emergency signal as that of the system receiving it.

DESCRIPTION OF THE DRAWINGS

FIG. 1 is a block diagram of the transmitter-encoder portion of the system.

FIG. 2 is a block diagram of the receiver-decoder portion of the system.

FIG. 3 is a circuit diagram of the transmitter-encoder portion of this system.

DESCRIPTION OF THE PREFERRED EMBODIMENTS

Figure 4:
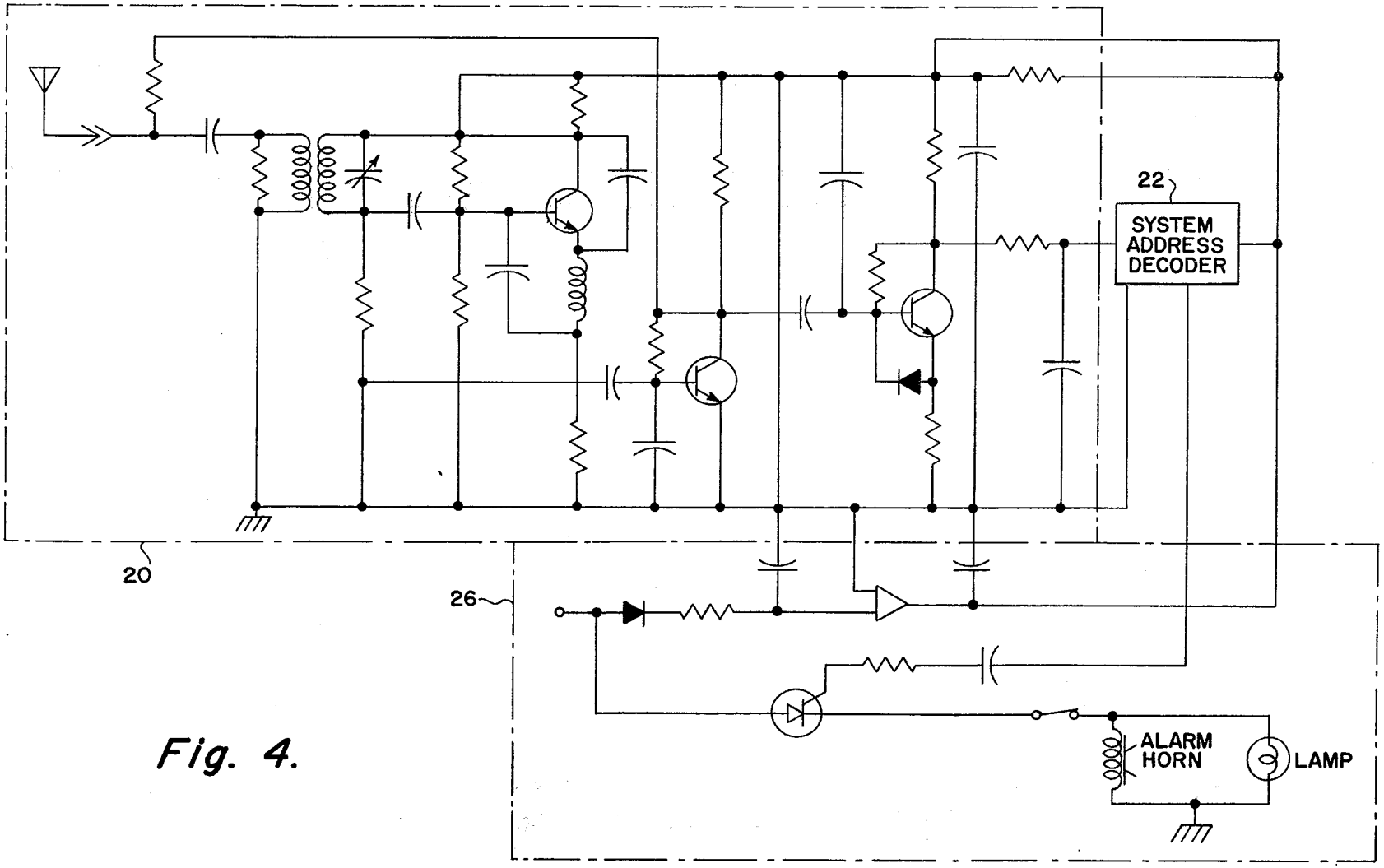
FIG. 4 is a circuit diagram of the receiver-decoder portion of the system.

This device comprises the means for transmitting a digital address over a short distance, receiving that address, recognizing that address and upon recognition triggering an alarm which may be audible or visual or both. In the preferred embodiment the system operates on a carrier frequency of 300 Mhz.

The preferred embodiment is capable of encoding up to 512 addresses thereby providing the capability of operating 512 systems in close proximity without interference of one with another. Provision can be made for incorporation of a greater number of addresses in the system.

The address encoder used in the preferred system is a Motorola Company integrated circuitchip having Motorola part number SC42131P. Nine address switches provide the means for setting up a desired address in the encoder.

Upon depression of an emergency switch located on the transmitter-encoder package, a burst of 10 pulses occuring at 4 Ms intervals is generated in the address encoder and modulates the carrier signal of the transmitter. The initial pulse of the pulse train is 3 Ms wide and is a reference pulse. The remaining 9 pulses contain the address information and may be either 1 Ms wide if a "one" is present or 3 Ms wide if a zero is present. Each of the nine address switches controls one pulse. When a switch is closed, a 1 Ms is produced in the address position corresponding to the switch.

A conventional receiver, which may be several hundred feet away from the transmitter in the preferred system, serially transfers the address information it receives to a digital system address decoder which compares the address received with an address set up in nine address switches located in the receiver package. If the addresses compare, an alarm is set.

To insure that legitimate data has been received and not noise, the decoder checks to see that a pulse is present in each time interval.

Once the alarm is set it may be reset manually only, thereby insuring that attention is given to the person experiencing the emergency.

In the preferred embodiment, the transmitter-encoder package is 2¾ inches long, 2¼ inches wide and 0.7 inches deep. In addition to the emergency switch and a battery condition indicator, the device is provided with snap fastners for a neck strap and a removable belt clip.

In the preferred embodiment the receiver-decoder package is 5 inches long, 4 inches wide and 3 inches deep.

With reference to FIG. 1, emergency switch 10 is connected between power supply 12 and the rest of the encoder transmitter system. Power is supplied to the system only when the switch is depressed. The address generated by system address encoder 14 is determined by the setting of switches 16. One switch is associated with each address position. When a switch is closed, a pulse 1 Ms wide will be produced at the corresponding address position. When a switch is open, a pulse 3 Ms wide will be produced at the corresponding address position.

As hereinbefore stated a pulse train of 10 pulses is produced by system address encoder 14. The first pulse produced is a reference pulse and is always 3 Ms wide. The remaining 9 pulses may be either 3 Ms or 1 Ms wide depending upon the setting of switches 16. Address encoder 14 is an integrated circuit device made by the Motorola Company having a Motorola part number of SC42131P.

System address encoder 14 is connected to transmitter 18. In the preferred embodiment, transmitter 18 is conventional and produces a 300 Mhz carrier which is modulated by the pulses eminating from address encoder 14 in response to depression of Switch 10.

Referring to FIG. 2, the modulated signal is detected by receiver 20, demodulated and transferred to system address decoder 22 where it is compared with the setting of switches 24. If the addresses compare Alarm 26 is set off. In the preferred embodiment, address decoder 22 is made by the Motorola Company and has a Motorola part number of SC42130P.

The portion of the system shown in FIG. 1 is shown in more detail in FIG. 3 and the portion of the system shown in FIG. 2 is shown in more detail in FIG. 4. The reference numbers used in FIGS. 3 and 4 are identical to those used in FIGS. 1 and 2. Conventional electrical symbols are used therein.

What is claimed is:

1. A transmitter-receiver emergency signalling device, the transmitter of which may be carried on the person, comprising:

(a) means for generating a system address pulse train of a fixed number of pulses, the width of each pulse being determined by whether or not the pulse represents a "one" or a "zero;"

(b) means for setting the pulse width of the pulses in the pulse train and thereby determining the system address;

(c) radio frequency transmission means the carrier signal of which is modulated by the pulse train;

(d) a radio frequency receiver means responsive to the transmitted signal;

(e) means for determing that each of the fixed number of pulses in the pulse train have been received;

(f) address decoding means adapted to receive the pulse train and compare an address received with the system address; and (g) an alarm responsive to a comparison of the received address and the system address.

* * * * *